US006966302B2

(12) United States Patent
Maroney

(10) Patent No.: US 6,966,302 B2
(45) Date of Patent: Nov. 22, 2005

(54) FUEL SYSTEM AND FLOW CONTROL VALVE

(75) Inventor: George E. Maroney, Kingston, MI (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 0 days.

(21) Appl. No.: 10/765,648

(22) Filed: Jan. 26, 2004

(65) Prior Publication Data

US 2005/0161027 A1 Jul. 28, 2005

(51) Int. Cl.[7] ..... F02M 55/00
(52) U.S. Cl. ..... 123/457; 123/511; 137/514.7
(58) Field of Search ..... 123/510–511, 457; 137/514.5, 514.7; 241/54

(56) References Cited

U.S. PATENT DOCUMENTS 3,680,587 A * 8/1972 Herscovici ..... 137/514.3
3,741,182 A * 6/1973 Wade et al. ..... 123/459
4,252,141 A * 2/1981 Burgdorf et al. ..... 137/101
4,603,710 A * 8/1986 Tiefenthaler ..... 137/514.7
4,964,391 A * 10/1990 Hoover ..... 123/510
5,050,636 A * 9/1991 Sagawa et al. ..... 137/494
5,183,075 A * 2/1993 Stein ..... 137/493.6
5,205,321 A 4/1993 Maroney et al.
5,452,701 A 9/1995 Tuckey
5,701,869 A * 12/1997 Richardson et al. ..... 123/497

* cited by examiner

*Primary Examiner*—Thomas Moulis
(74) *Attorney, Agent, or Firm*—Reising, Ethington, Barnes, Kisselle, P.C.

(57) ABSTRACT

A valve for controlling flow of a fluid includes a valve body defining at least in part an inlet, an outlet, at least one chamber, and an orifice in communication with the chamber. A valve member is received at least in part in one chamber for reciprocation or rotation between an open position permitting fluid flow through the inlet and into the outlet, and a closed position at least substantially restricting fluid flow through the outlet. In the reciprocating version the movement of the spool toward its open position causes fluid in the chamber to be displaced out of the cavity through the at least one orifice. In one exemplary embodiment, a fuel system includes a valve between a primary fuel pump and a secondary fuel pump driven by a portion of the output of pressurized fuel from the primary fuel pump.

46 Claims, 2 Drawing Sheets

FUEL SYSTEM AND FLOW CONTROL VALVE

FIELD OF THE INVENTION

This invention relates generally to fuel systems and more particularly to a fluid flow control valve, and a fuel system including a flow control valve.

BACKGROUND OF THE INVENTION

In delivering fuel from a fuel tank to an engine, it is known to use an electric motor fuel pump to deliver fuel under pressure from the fuel tank through a fuel line to a fuel rail and fuel injectors of the engine. It is also known to incorporate a jet pump driven by a portion of the output of the fuel pump to transfer fuel from one location to another. For example, in a two fuel tank system, a jet pump may be used to transfer fuel from one fuel tank to the other. Since the jet pump uses a portion of the fuel pump output, less fuel is available for delivery to the engine. This can pose a problem in some operating conditions, such as during a cold start. During a cold start, the fuel pump may deliver fuel at a less than normal flow rate which can make it difficult to start the engine. This can be particularly troublesome where more than one jet pump or other auxiliary feed stems from the fuel line supplying the engine.

SUMMARY OF THE INVENTION

A valve for controlling flow of a fluid includes a valve body defining at least in part a chamber and having an inlet, an outlet, an orifice in communication with the chamber, and a spool received at least in part in the chamber for reciprocation between an open position permitting fluid flow through the inlet and to the outlet, and a closed position at least substantially restricting fluid flow from the inlet to the outlet. The movement of the spool toward its open position causes fluid in the cavity to be displaced out of the chamber through said at least one orifice. Desirably, the orifice can be constructed and arranged to provide a restriction to fluid flow therethrough to control, at least in part, the movement of the spool toward the open position.

In one presently preferred implementation, a valve is provided in a fuel system between a primary fuel pump and a secondary fuel pump that is driven by a portion of the output of pressurized fuel from the primary fuel pump. The valve defines at least in part a chamber in communication with the interior of a fuel tank and in which fuel may be received, an inlet in communication with the output of the primary fuel pump, an outlet in communication with the secondary fuel pump, at least one orifice in fluid communication with the chamber, and a spool received at least in part in the chamber for reciprocation between an open position permitting fuel flow through the inlet and to the outlet and a closed position at least substantially restricting fuel flow from the inlet to the outlet. Movement of the spool toward its open position causes fuel in the chamber to be displaced out of the chamber through the orifice or orifices. Desirably, upon initial actuation of the primary fuel pump, such as when it is desired to start an engine fed by the primary fuel pump, the valve reduces or prevents fuel flow to the secondary fuel pump for some period of time. Thus, during starting of an engine, all or substantially all of the fuel discharged from the primary fuel pump is available to the engine to facilitate starting the engine, even in cold ambient conditions.

Objects, features and advantages of this invention include providing a fuel system with a valve that increases the fuel flow rate to an engine during starting of the engine, improves the efficiency of the fuel system, has a rapid shut off, resists clogging, resists binding, resists fuel leakage, operates over a wide range of fuel viscosity, is of relatively simple design, and is economical in manufacture and assembly.

BRIEF DESCRIPTION OF THE DRAWINGS

These and other objects, features and advantages of this invention will become apparent from the following detailed description of the preferred embodiments and best mode, appended claims and accompanying drawings in which:

DETAILED DESCRIPTION OF THE PREFERRED EMBODIMENTS

Figure 1:
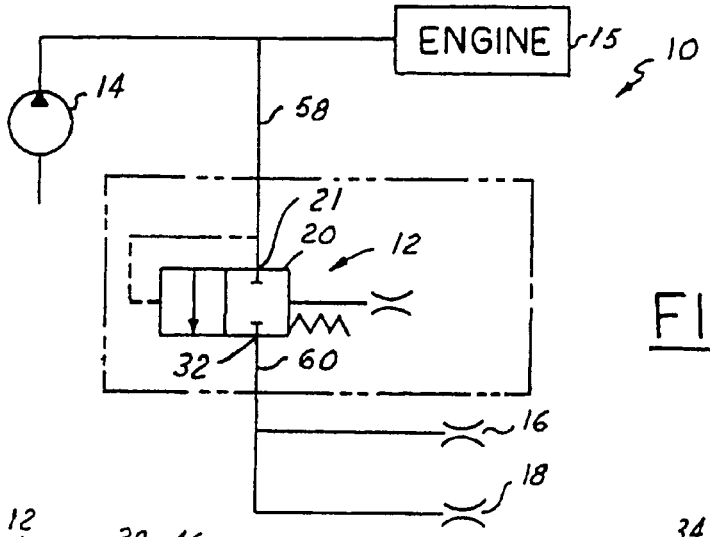
FIG. 1 is a schematic view of a fuel system incorporating a valve according to one embodiment of the present invention.
Figure 2:
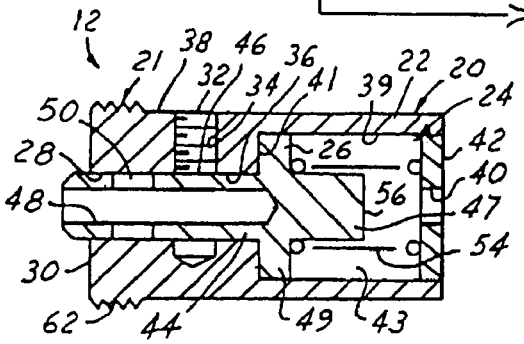
FIG. 2 is a cross-sectional view of one form of a valve shown in a closed position.
Figure 3:
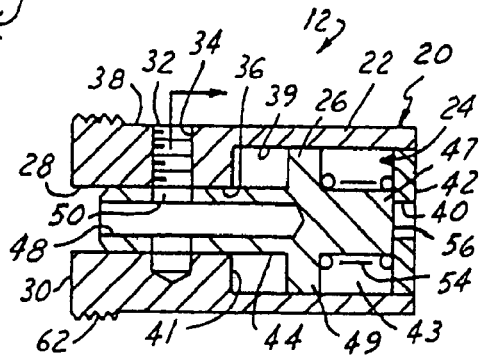
FIG. 3 is a cross-sectional view of the valve of FIG. 2 shown in an open position.

Referring in more detail to the drawings, FIGS. 1–3 illustrate a fuel system 10 that has one presently preferred construction of a flow control valve assembly 12 interposed between a primary fuel pump 14 and at least one secondary fuel pump, represented here as a pair of jet pumps 16, 18. The valve 12 has a valve member or spool 26 that moves between a closed position (FIG. 2) to delay the flow of liquid fuel from the primary fuel pump 14 to the jet pumps 16, 18, thereby directing the entire flow of fuel to an engine 15 at least in certain conditions upon initial actuation of the primary fuel pump. For example, this can be desirable during starting of the engine 15, particularly when the high pressure pump 14 provides a reduced fuel flow rate, for example, during cold ambient temperatures. After some delay from initial actuation of the primary fuel pump, the valve 12 moves at least partially to an open position (FIG.

3) to enable at least a portion of the fuel output from the primary fuel pump 14 to flow to and drive the jet pumps 16, 18.

The primary fuel pump 14 is preferably a high pressure electric motor driven fuel pump capable of supplying pressurized fuel to satisfy an engine's demand. The electric motor fuel pump may be of substantially any kind including, without limitation, positive displacement and regenerative or turbine-type fuel pumps. In an automotive vehicle the electric motor of the fuel pump is powered by an electrical system having a storage battery. In cold weather when starting the engine, the battery system will supply current at a lower than normal voltage to the electric motor during starting of a cold engine, thereby decreasing the output of high pressure fuel to the engine during cold starting. In such cold starting conditions it is desirable to deliver the entire output of high pressure fuel by the electric pump to the engine for starting.

As represented in FIG. 1, the valve assembly 12 has a body 20 with an inlet 21 for connection to at least one fuel line 58 coming from the primary fuel pump 14 and an outlet 32 for connection to at least one fuel line 60 leading to the jet pumps 16, 18. As shown in FIG. 2, a fluid conduit connector 62 is preferably formed adjacent the end 30 of the valve body 20 to facilitate connection to the fuel line 58 coming from the primary fuel pump 14. The connector 62 as shown includes male threads for threaded engagement with a complementary mating female threaded connector coupled to the line 58. Suitable barbs for frictional engagement of an end of a flexible conduit, and other connector constructions can also be used. The outlet 32 is formed in a tubular wall 22 of the body 20 and is preferably either threaded or otherwise arranged for connection to the fuel line 60 leading to the jets pumps 16, 18. It should be recognized that the valve body 20 may be molded as a single piece of material, such as plastic, metal, or any other suitable material, or could be cast, machined, or otherwise fabricated as desired.

As best shown in FIGS. 2 and 3, the tubular wall 22 of the valve body 20 defines at least in part a counterbore 24 in which the spool 26 is slidably received. The tubular wall 22 is preferably cylindrical in form, although any geometry may be incorporated as desired for the intended application. The valve body 20 has an inlet bore 28 preferably constructed in one end 30 of the valve body 20 in communication with the primary fuel pump 14, and coaxial with and opening into the counterbore 24, and an outlet 32 in communication with the jet pumps 16, 18. The outlet 32 is defined at least in part by a threaded bore 34 transverse to and opening at one end into the bore 28 and extending to an outer surface 38 of the valve body 20.

The valve body 20 has an orifice 40 extending through an end wall or plug 42 sealed in the valve body 20 and communicates with a chamber 43 that is defined at least in part between the spool 26 and the valve body 20. The chamber 43 is open to the orifice and fuel is received in the chamber 43 in use of the valve. The spool 26 preferably prevents or at least significantly restricts fluid communication of the chamber with both the inlet 21 and outlet 32. Therefore, in this embodiment, fuel flows into and out of the chamber 43 substantially only through the orifice 40. The orifice 40 provides a restricted fuel flow path out of the chamber 43. The orifice 40 is preferably sized to provide a desired restriction to control fuel flow out of the chamber 43, and hence, to control at least in part the movement of the spool 26 toward the open position. The end wall 42 may either be formed as one piece with the valve body 20, or alternatively may be formed as a separate piece of material carried by or attached and sealed to the valve body. It should be recognized that the inlet 28, outlet 32, and orifice 40 may be constructed in other locations of the valve body 20 and that the drawings only represent an exemplary embodiment of one currently preferred construction of the valve body 20.

As shown in FIGS. 2 and 3, the spool 26 is generally cylindrical along at least a portion of its length and has a stem 44, a head 47, and a flange 49 extending radially outwardly from an outer surface 46 of the spool 26 between the stem 44 and head 47. The stem 44 is slidably received and guided for reciprocation in the bore 28. The stem 44 has an axially extending blind bore 48 and a transverse opening 50 extending through the stem and the bore 48 and disposed to communicate with the passage 34 when the spool is retracted to open the valve.

The flange 49 extends radially outwardly from the outer surface 46 and is preferably closely received in the counter bore 24 to provide a piston in the chamber 43 and preferably to guide the spool as it reciprocates in the chamber. The flange 49 engages an end or stop surface 41 of the counterbore 24, when the spool 26 is in its fully closed position, as shown in FIG. 2.

The head 47 of the spool 26 extends axially from the flange 43 and preferably retains one end of a spring 54. The spring 54 is arranged to bear on the flange 43 and end wall 42 of the valve body 20 to yieldably bias the spool 26 toward its closed position. It should be recognized that the performance of the valve 12 may be altered or adjusted by incorporating springs having different lengths and/or spring constants.

When the spool 26 of the valve 12 is in its closed position the stem 44 closes the outlet passage 34 to prohibit or obstruct the flow of fuel to the jet pumps 16, 18, so that all or substantially all of the output of fuel from the primary fuel pump 14 is directed to the engine 15. The spool 26 moves to its open position to allow fuel to flow from the inlet 28, through the bore 48 and opening 50 in the stem and the passage 34 to the jet pumps 16, 18 when desired.

As shown in FIG. 2, when the spool 26 is in the fully closed position, the stem 44 of the spool 26 obstructs or closes the passage 34 leading to the outlet 32. Accordingly, when the spool is in the fully closed position, no significant portion of the fuel output from the high pressure fuel pump 14 is diverted from the engine. Therefore, when the fuel pressure at the inlet 21 of the valve is low enough to permit the spring 54 and any fuel pressure in the chamber 43 to cause the spool 26 to be in its closed position, fuel is not directed to the secondary jet pumps 16, 18. This may be desirable, for example, during a start of the engine in cold ambient conditions, wherein the electric motor fuel pump powered by a vehicle battery may not initially deliver fuel at full pressure and fuel flow rate, and hence, it is not desirable to divert any flow to the secondary fuel pumps. In such a case, the spool 26 remains biased is in its closed position by the spring 54 and retarding effect provided by the fuel in the chamber 43 and orifice 40 to avoid parasitic flow of fuel to the jet pumps 16, 18, thereby sending all, or essentially all of the fuel discharged from the fuel pump 14 to the engine 15.

The spool moves from its closed position toward its open position when the pressure of fuel at the inlet 21 acting on the stem 44 produces a sufficient force to move the spool 26 against the force produced by the spring 54 and the fuel in chamber 43 which is discharged through the orifice 40. The restricted flow of fuel out of the chamber 43 through the orifice 40 controls at least in part the movement of the spool 26 toward the open position. As the spool 26 moves toward the open position, the opening 50 in the spool 26 becomes partially registered with the outlet 32 in the valve body 20 so that fuel can flow through the inlet 28, the bore 48, opening 50, passage 34, and out the outlet 32 of the valve body 20 to supply pressurized fuel to the jet pumps 16, 18. The delay in opening the valve assembly 12, for example when the primary electric fuel pump 14 is initially actuated or turned on to start the engine, ensures that all or substantially all of the fuel output of the primary fuel pump 14 is initially available to the engine to facilitate starting the engine. As the fuel pressure at the inlet 28 decreases, the biasing force of the spring 54 moves the spool 26 toward the closed position and fuel re-enters the chamber 43 through orifice 40.

Figure 4:
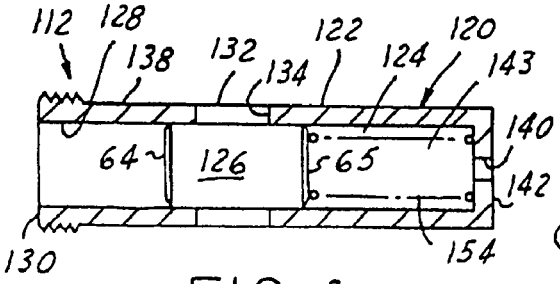
FIG. 4 is a cross-sectional view of a second embodiment of a valve shown in a closed position.
Figure 5:
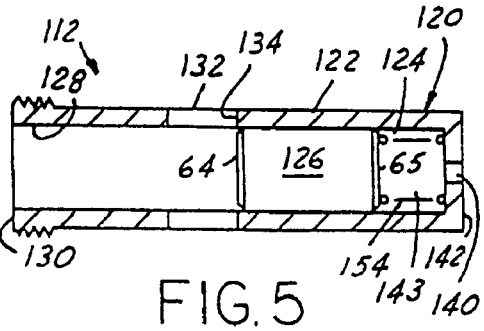
FIG. 5 is a cross-sectional view of the valve of FIG. 4 shown in an open position.

In FIGS. 4 and 5, a valve assembly 112 constructed according to a second presently preferred embodiment is shown in closed and open positions, respectively. Similar components to the first embodiment valve 12 are given similar reference numerals, but are offset by 100.

The valve 112 has a valve body 120 with a chamber 143 defined at least in part by a tubular wall 122. The valve body 120 is generally cylindrical having an end 130 with a counterbore 128 and an opposite end having an end wall 142 with a throughbore defining an orifice 140 extending therethrough. The valve body 120 has a passage 134 open at one end to the counterbore 128 and extending to an outer surface 138 of the valve body 120 defining an outlet 132 of the valve 112.

A spool 126 is slidably received with a close fit in the chamber 143 for reciprocation between an open position in response to fuel pressure acting on the spool 126 in one direction and a closed position in response, at least in part, to the force of a spring 154 acting on and yieldably biasing the spool 126 in the opposite direction. The spool 126 is generally cylindrical along its length having a pair of opposite ends 64, 65 and is preferably formed as a solid piece of material. In its closed position, the spool 26 obstructs or closes the passage 134 to at least substantially restrict or prevent fuel flow to the outlet 132.

A spring 154 is received in the chamber 143, bears on the end 65 of the spool 126 and the end wall 142 of the valve body 120 and yieldably biases the spool 126 toward the closed position. Sufficient fuel pressure at the inlet 128 acts on the end 64 to move the spool 126 toward its open position so that the end 64 of the spool 126 registers, at least in part, with the passage 134, and thus the outlet 132 in the tubular wall 122. Preferably, when the spool 126 is in the fully open position, the end 64 of the spool 126 is completely clear of the passage 134, thereby allowing fuel to freely flow without restriction through the passage 134, and thus the outlet 132. Movement of the spool 126 toward its open position is controlled at least in part by the spring 154 and the restricted flow of fuel out of the chamber 143 that is controlled in part by the size of the orifice 140. Otherwise, the valve assembly 112 functions substantially the same as in the valve assembly 12, and thus, operation of the valve assembly 112 will not be discussed further.

Figure 6:
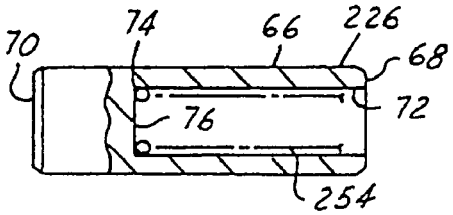
FIG. 6 is a partial cross-sectional view of one embodiment of a spool of a valve.

In FIG. 6, a partially sectioned side view of a modified spool 226 is shown, wherein similar reference numerals are used as in the first embodiment of spool 26 to describe like components which however are offset by 200.

The spool 226 has a generally cylindrical outer surface 66 with a pair of opposite ends 68, 70 wherein one of the ends 68 has a pocket 72 extending therein to a base 76. A spring 254 is received at least in part in the pocket 72 so that an end 74 of the spring 254 bears on the base 76 of the pocket 72. The other end (not shown) of the spring 254 bears on an end wall of the valve body (not shown), as in the previous embodiments. With the spring 254 extending at least partially into the pocket 72, a longer spring can be used within the valve body 220, thus providing a greater range of spring force in use of a given spring. Otherwise, the function of the spool 226 is substantially the same as the spools 126, 26, and thus, is not described further.

Figure 7:
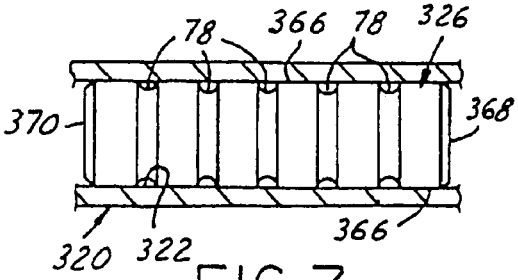
FIG. 7 is a side view of another embodiment of a spool of a valve.

FIG. 7 shows another modified spool 326. The spool 326 has a generally cylindrical outer surface 366 with a pair of opposite ends 368, 370. The outer surface 366 has at least one, and as shown here, a plurality of circumferentially continuous grooves 78 extending radially inwardly of the outer surface 366. The circumferential grooves 78 allow fuel to flow between a wall 322 of a valve body 320 and within the grooves 78. As such, a hydrodynamic seal of fuel is established between the spool 326 and the wall 322 of the valve body 320. The hydrodynamic seal allows the spool 326 to be constructed having an increased clearance relative to the wall 322 of the valve body 320, thereby allowing greater manufacturing tolerances in the construction of the spool 326 and the bore 324 of the valve body 320. It should be recognized that the number of circumferential grooves 78 along the length of the spool 326 can be varied depending on the particular application, and that the embodiment shown is exemplary of one currently preferred construction. Otherwise, the operation of a valve utilizing spool 326 is substantially the same as in the previous embodiments, and thus, is not described further.

Figure 8:
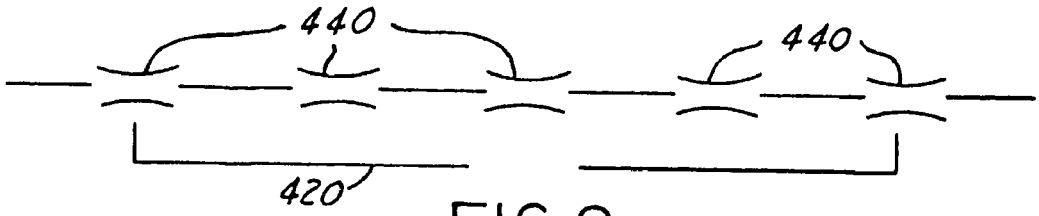
FIG. 8 is a schematic view of one embodiment showing a plurality of orifices in series.

FIGS. 8–13 represent alternate embodiments having a plurality of orifices provided in a valve. FIG. 8 schematically shows a plurality of orifices 440 in series formed in a valve body 420.

Figure 9:
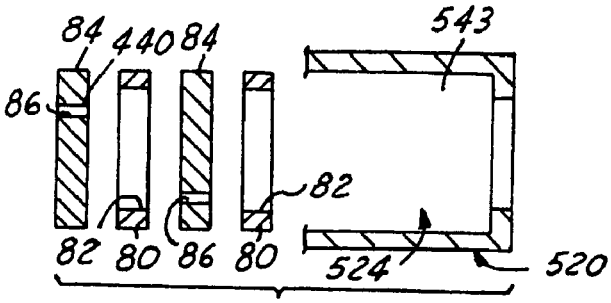
FIG. 9 is an exploded cross-sectional view of a plurality of plates having orifices that control fuel flow according to one embodiment of a valve.
Figure 10:
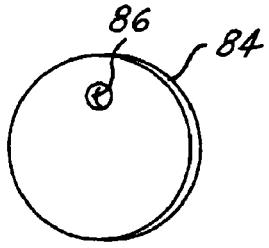
FIG. 10 is a perspective view of one of the plates shown in FIG. 9.

As shown in FIGS. 9 and 10, a plurality of washers 80 and disks 84 interleaved or stacked adjacent one another define a plurality of orifices 86 in series. Each disk 84 has an orifice or through hole 86, and desirably, at least two of the orifices 86 are radially and/or circumferentially offset from one another defining a generally serpentine flow path through the stacked disks 84 and spacer washers 80. The washers 80 have enlarged through holes 82 and disks 84 have through orifices 86 that are smaller in size than the through holes 82 wherein the orifices 86 restrict fuel flow therethrough. The through orifices 86 are represented as being similar in size, though it should be understood that they can be formed having different sizes, depending on the desired fuel flow characteristics for the intended application. Though the smaller through orifices 86 are shown circumferentially offset from one another, it should be recognized that they could be aligned with or radially offset from one another, while still providing reductions in pressure as the fuel flows through the orifices 86.

The disks 84 and spacer washers 80 are preferably received as an insert or plug within a chamber 543 of a valve body 520 to provide a plurality of orifices that restrict or control fuel flow out of the chamber 543 to provide orifices downstream of a spool. By incorporating a plurality of stacked disks and spacer washers, otherwise larger through holes 86 can be utilized in the individual disks 84, while still providing for the desired restriction to fuel flow out of the chamber of the valve body. By incorporating through holes 86 with an increased size (compared to a single orifice), the likelihood of the through holes 86 becoming clogged is reduced. It should be recognized that the embodiment shown in FIG. 9 is exemplary of one currently preferred construction, and that other constructions are possible depending on the specific fuel flow requirements of the intended application.

Figure 11:
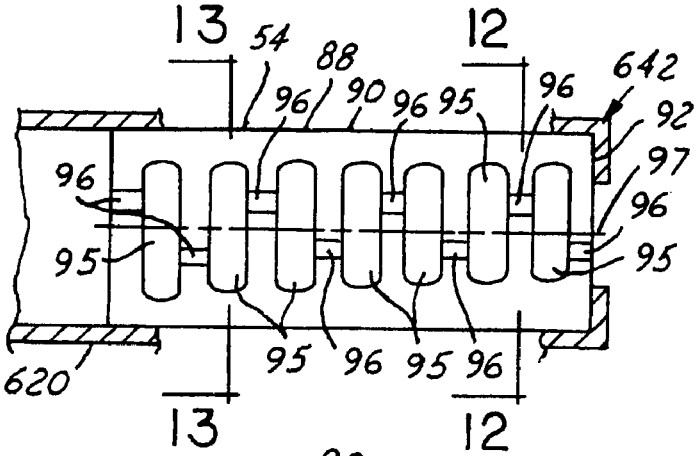
FIG. 11 is a fragmentary side view partially in section of another embodiment of a valve body of a valve including a plug with a plurality of orifices providing a serpentine flow path.
Figure 12:
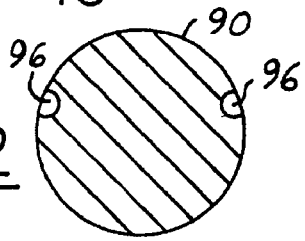
FIG. 12 is a cross-sectional view taken generally along line 12—12 of FIG. 11.

Another embodiment of a plurality of orifices in a valve body 620 is shown in FIG. 11. In this embodiment, the orifices are defined in a generally cylindrical plug or body 88 with an outer surface 90 and a pair of generally opposite ends 92, 93. The outer surface 90 has a generally serpentine flow path formed therein that extends along a longitudinal axis 97, and preferably over the length of the body 88. The body 88 is preferably attached to or carried by a valve body 620 such that the cylindrical body 88 forms an end wall 642 of the valve body 620.

Figure 13:
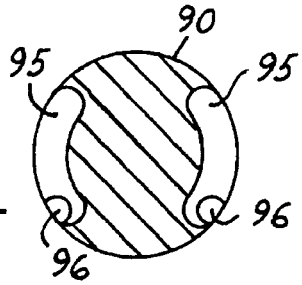
FIG. 13 is a cross-sectional view taken generally along line 13—13 of FIG. 11.

As shown in FIG. 13, the serpentine flow path in the body 88 includes scallops 95 extending generally radially inwardly and circumferentially relative to the longitudinal axis 97 of the body 88 and a plurality of groove or channel orifices 96 extending between the scallops 95. Desirably, the adjacent channel orifices 96 are circumferentially offset from one another to provide the serpentine flow path of the fuel across the outer surface 90 of the body 88. Preferably, the channel orifices 96 are sized to provide a desired restriction to fuel flow therethrough, and hence, define orifices in the body 88. Any number of orifices may be formed in either staggered or aligned relation with one another. The body 88 is preferably formed as a single piece of material utilizing a molding or machining process.

Figure 14:
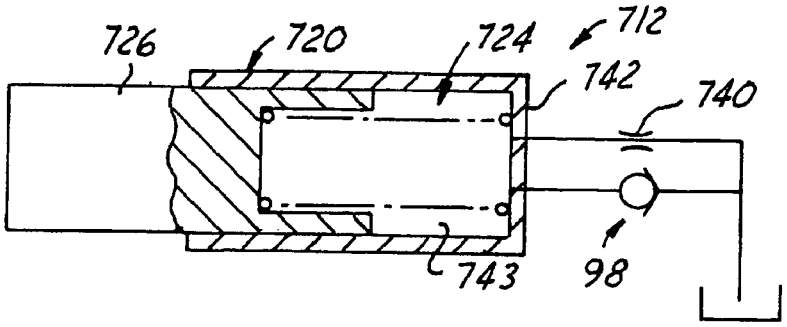
FIG. 14 is a schematic view of an alternate embodiment of a valve.

As shown in FIG. 14, another embodiment of a valve 712 has a valve body 720 with a chamber 743 that receives a spool 726 for reciprocating movement between a closed position and an open position. The valve 712 has an orifice 740 and a check valve 98 allowing fuel to reenter the chamber 743 between the spool 726 and an end 742 of the valve body 720. The check valve 98 prevents fuel from leaving the chamber 743 therethrough, and has a larger flow area and rate than the orifice 740 to permit more rapid reentry of fuel into the chamber 743 as the spool 726 is retracted. Otherwise, the valve 712 functions substantially the same as in the previous embodiments, and thus is not described further.

The embodiments described above are exemplary embodiments of the currently preferred constructions, and thus are intended to be illustrative and not limiting. Modifications and substitutions can be made without departing from the spirit and scope of the invention as set forth in the following claims. For example, while the valve member of one or more presently preferred embodiments has been shown and described as a spool slidably received in a valve body, the valve member could be, by way of example and without limitation, a rotary valve plate or disc that is rotated in response to a pressure signal to open an outlet of the valve. The rotary valve plate may be coupled to a valve including a slidable spool like that disclosed that is driven by a fluid signal as disclosed to rotate the rotary valve plate. Hence, the rotary valve plate would control the opening and closing of the outlet leading to the secondary fuel pump, rather than the spool directly controlling flow through the outlet. The scope of the invention is defined by the following claims.

What is claimed is:

1. A fuel system with a fuel tank having an interior adapted to retain a supply of fuel for an internal combustion engine, comprising:

a primary fuel pump having an inlet in communication with the interior of the fuel tank and through which fuel is supplied to the primary fuel pump, and an output of pressurized fuel for delivery to an engine;

a secondary fuel pump driven by some of the output of pressurized fuel of the primary fuel pump;

a valve having an inlet communicating with the output of pressurized fuel of the primary pump, an outlet for communicating pressurized fuel from the inlet with the secondary fuel pump and movable to open and closed positions, a chamber in the valve in which fuel may be received, the inlet and outlet of the valve do not communicate with the chamber, at least one orifice in fluid communication with the chamber and the interior of the fuel tank, and a valve member received at least in part in the chamber for movement between a position opening the valve to permit flow of pressurized fuel to the secondary fuel pump and to a position closing the valve to at least substantially restrict fuel flow to the secondary pump, and movement of the valve member toward the position opening the valve causes fuel in the chamber to be displaced out of the chamber through said at least one orifice to retard opening of the valve.

2. The fuel system of claim 1 further comprising a spring and wherein the valve member includes a spool with the spring yieldably biasing the spool toward the closed position.

3. The fuel system of claim 2 wherein an end of the spool has a pocket extending therein for receiving at least a portion of the spring.

4. The fuel system of claim 1 wherein the valve member is a spool that at least substantially prevents the inlet and outlet of the valve from communicating with the chamber.

5. The fuel system of claim 4 wherein the chamber communicates with the interior of the fuel tank through said at least one orifice so that fuel enters the chamber and leaves the chamber through said at least one orifice.

6. The fuel system of claim 4 which also includes a check valve in communication with the chamber to permit fuel to enter the chamber through the check valve and prevent fuel from leaving the chamber through the check valve.

7. The fuel system of claim 6 wherein the check valve has an opening with a flow area that is greater in size than said at least one orifice to permit fuel to enter the chamber through the check valve at a faster rate than through said at least one orifice.

8. The fuel system of claim 1 wherein the valve includes a valve body with said at least one orifice formed in the valve body.

9. The fuel system of claim 8 wherein said at least one orifice comprises a plurality of orifices with each orifice formed in said valve body.

10. The fuel system of claim 9 wherein the valve body includes a plug and at least one of said orifices is formed in the plug.

11. The fuel system of claim 9 wherein the valve body includes a plug and a plurality of orifices are formed in the plug.

12. The fuel system of claim 10 wherein said plug includes a plurality of disks and spacers disposed adjacent one another with each disk having a through hole.

13. The fuel system of claim 12 wherein at least two of the through holes are circumferentially offset from one another.

14. The fuel system of claim 12 wherein at least an adjacent disk and a spacer have differently sized through holes.

15. The fuel system of claim 12 wherein at least two disks have similarly sized through holes and a spacer washer positioned between said two disks has a through hole that is larger than either of the through holes in said two disks.

16. The fuel system of claim 15 wherein said similarly sized through holes are circumferentially offset from one another.

17. The fuel system of claim 10 wherein said plug includes at least one scallop extending generally circumferentially relative to a longitudinal axis of the body and has at least two channels extending generally axially from the at least one scallop and in generally opposite directions from one another, said scallop and channels defining a serpentine flow path including said at least one orifice.

18. The fuel system of claim 1 wherein the valve member comprises a spool which is cylindrical.

19. The fuel system of claim 18 wherein the spool has an outer surface and at least one circumferential groove extending radially into the outer surface.

20. The fuel system of claim 19 wherein the spool is molded as a single piece of material.

21. The fuel system of claim 1 wherein the valve member includes a spool and the chamber has a stop surface for engaging the spool when the spool is in the closed position.

22. The fuel system of claim 21 wherein the spool has a flange extending radially outwardly from an outer surface of the spool for engaging the stop surface when the spool is in the closed position.

23. The fuel system of claim 22 further comprising a spring bearing on the flange and yieldably biasing the spool toward the closed position.

24. The fuel system of claim 1 wherein the valve member includes a spool that has a bore extending along at least a portion of its length and in communication with the inlet for receiving fuel flowing in the inlet of the valve body tending to move the spool toward the open position.

25. The fuel system of claim 24 wherein the spool has an outer surface with an opening communicating with the bore allowing fuel to flow in the inlet, through the bore, out the opening and through the outlet when the spool is in the open position.

26. The fuel system of claim 25 wherein the opening registers at least in part with the outlet in the valve body when the spool is in the open position and the opening is spaced from the outlet when the spool is in the closed position.

27. The fuel system of claim 1 wherein the secondary pump is a jet pump including a nozzle in communication with the outlet of the valve and a venturi aligned with the nozzle.

28. The fuel system of claim 1 wherein said at least one orifice is sized to provide a restriction to fuel flow out of the chamber and control at least in part the movement of the valve member toward the open position.

29. The fuel system of claim 9 wherein the plurality of orifices are arranged in series to provide a restriction to fluid flow out of the chamber and control at least in part the movement of the spool toward the open position.

30. A valve for a fuel system with a fuel tank for controlling flow of a fluid, comprising:

a valve body having an inlet, an outlet and defining at least in part a chambers, an orifice in communication with the chamber and the fuel tank, and the inlet and outlet do not communicate with the chamber; and a valve member received at least in part in the chamber for reciprocation between an open position permitting fluid flow through the inlet and into the outlet, and a closed position at least substantially restricting fluid flow from the inlet through the outlet, and movement of the valve member toward its open position causing fluid in the chamber to be displaced out of the chamber through said at least one orifice.

31. The valve of claim 30 further comprising a spring yieldably biasing the valve member toward the closed position.

32. The valve of claim 30 wherein the valve member includes a spool and the chamber is defined at least in part by the spool and is in communication with said at least one orifice with the inlet and outlet of the valve at least substantially prevented from communicating with the chamber.

33. The valve of claim 32 wherein fluid enters the chamber and leaves the chamber through said at least one orifice.

34. The valve of claim 32 which also includes a check valve in communication with the chamber to permit fluid to enter the chamber through the check valve and prevent fluid from leaving the chamber through the check valve.

35. The valve of claim 34 wherein the check valve has an opening with a flow area that is greater in size than said at least one orifice to permit fluid to enter the chamber through the check valve at a faster rate than through said at least one orifice.

36. The valve of claim 30 wherein said at least one orifice comprises a plurality of orifices with each orifice received in said valve body.

37. The valve of claim 36 wherein the valve body includes a plug and at least one of said orifices is formed in the plug.

38. The valve of claim 36 wherein the valve body includes a plug and a plurality of orifices are formed in the plug.

39. The valve of claim 38 wherein said plug includes a plurality of disks disposed adjacent one another with each disk having a through hole.

40. The valve of claim 38 wherein said plug includes at least one scallop extending generally circumferentially relative to a longitudinal axis of the body and has at least two channels extending generally axially from the at least one scallop and in generally opposite directions from one another, said scallop and channels defining a serpentine flow path including said at least one orifice.

41. The valve of claim 30 wherein the valve member comprises a generally cylindrical spool.

42. The valve of claim 30 wherein the valve member includes a spool that has a bore extending along at least a portion of its length and in communication with the inlet for receiving fluid flowing in the inlet of the valve body and tending to move the spool toward the open position.

43. The valve of claim 42 wherein the spool has an outer surface with an opening communicating with the bore allowing fluid to flow in the inlet, through the bore, out the opening and through the outlet when the spool is in the open position.

44. The valve of claim 43 wherein the opening registers at least in part with the outlet in the valve body when the spool is in the open position and the opening is spaced from the outlet when the spool is in the closed position.

45. The valve of claim 30 wherein said at least one orifice is sized to restrict fluid flow out of the chamber and control at least in part the movement of the valve member toward the open position.

46. The valve of claim 36 wherein the plurality of orifices are arranged in series to provide a restriction to fluid flow out of the chamber and control at least in part the movement of the valve member toward the open position.

* * * * *

UNITED STATES PATENT AND TRADEMARK OFFICE

CERTIFICATE OF CORRECTION

PATENT NO. : 6,966,302 B2
APPLICATION NO. : 10/765648
DATED : November 22, 2005
INVENTOR(S) : George E. Maroney It is certified that error appears in the above-identified patent and that said Letters Patent is hereby corrected as shown below:

Column 9
Line 55, delete “chambers” and insert -- chamber --.

Signed and Sealed this

Twenty-first Day of November, 2006

JON W. DUDAS
*Director of the United States Patent and Trademark Office*